United States Patent [19]

Baldwin et al.

[11] Patent Number: 4,943,901

[45] Date of Patent: Jul. 24, 1990

[54] LUMINAIRE WITH AUXILIARY REFLECTING MEANS

[75] Inventors: Samuel L. Baldwin, E. Flat Rock; Mitchell M. Osteen, Zirconia, both of N.C.

[73] Assignee: General Electric Company, Schenectady, N.Y.

[21] Appl. No.: 378,348

[22] Filed: Jul. 11, 1989

[51] Int. Cl.[5] ..... F21V 7/02

[52] U.S. Cl. ..... 362/277; 362/319; 362/346

[58] Field of Search ..... 362/296, 297, 304, 346, 362/347, 277, 319

[56] References Cited

U.S. PATENT DOCUMENTS

| | | | |
|---|---|---|---|
| 1,286,534 | 12/1918 | Cochran | 362/346 |
| 1,692,069 | 11/1928 | Ames | 362/277 |
| 1,973,086 | 9/1934 | Livers | 362/304 |
| 2,017,716 | 10/1935 | Halvorson | 362/304 X |
| 4,112,483 | 9/1978 | Small, Jr. et al. | 362/297 X |
| 4,701,832 | 10/1987 | Lasker | 362/297 X |

FOREIGN PATENT DOCUMENTS

| | | | |
|---|---|---|---|
| 489825 | 10/1918 | France | 362/304 |
| 525009 | 9/1921 | France | 362/304 |
| 98178 | 3/1923 | Switzerland | 362/304 |

*Primary Examiner*—Ira S. Lazarus
*Assistant Examiner*—Richard R. Cole
*Attorney, Agent, or Firm*—John P. McMahon; Stanley C. Corwin; Fred Jacob

[57] ABSTRACT

This luminaire comprises a generally dome-shaped main reflector having a bottom opening and a top opening and a lamp within the main reflector defining a light source located between the top and bottom openings. This main reflector, when mounted in a location above a warehouse aisle, is adapted to illuminate stacked material along both edges of the aisle with light passing through the bottom opening. Positioned above the top opening are auxiliary reflectors for receiving light from the source passing through the top opening and for reflecting such light to the edges of the aisle onto regions of the stacked material that are poorly illuminated by light passing through the bottom opening.

24 Claims, 4 Drawing Sheets

LUMINAIRE WITH AUXILIARY REFLECTING MEANS

This invention relates to a luminaire that comprises a main reflector for directing light downwardly onto material positioned along the edges of a warehouse aisle or the like and, more particularly, relates to a luminaire of this type that further includes auxiliary reflecting means above the main reflector for directing light onto regions of the material that are not well illuminated by light from the main reflector.

BACKGROUND

Certain luminaires are designed for illuminating stacked material along warehouse aisles or the like. An example of such a luminaire is disclosed and claimed in U.S. Pat. No. 4,303,971 - Hogue et al, assigned to the assignee of the present invention. These luminaires are typically disposed above the aisle in spaced locations along the aisle length. In the usual installation of this type, each luminaire directs light toward the stacked material at the edges of the aisle, with a major portion of the luminous flux being directed to the areas midway between adjacent luminaires. Traditionally, luminaires used in these applications have produced intense illumination on the stacks immediately adjacent the luminaire, leaving the upper areas of the stacks between the luminaires relatively dark and difficult to see. To alleviate this problem, luminaires have some times been Provided with "up-light" openings in the top of their reflectors. But even these luminaires do not provide an effective solution to this problem, since most of the light that is emitted upwardly is directed toward the ceiling only.

OBJECTS

An object of our invention is to provide a luminaire designed for illuminating stacks at the edges of a warehouse aisle or the like with means for increasing the effectiveness of the luminaire in illuminating the upper areas of the stacks, especially those upper areas between luminaires disposed at spaced locations along the aisle length.

Another object is to provide this more effective lighting of the upper areas of the stack without significantly detracting from the ability of the luminaire to illuminate the lower areas of the stacks and the aisle itself.

SUMMARY

In carrying out the invention in one form, we provide a luminaire that comprises a generally domeshaped main reflector having a wall extending about an axis and defining a bottom opening and a top opening in the main reflector that are located on the axis. Within the main reflector and extending substantially along said axis is a lamp defining a light source located in a position between the top and bottom openings. The main reflector is adapted to be mounted with its axis extending substantially in a location above a warehouse aisle, where it will illuminate stacked material along both edges of the aisle with light passing through said bottom opening. Auxiliary reflectors are positioned above the top opening for receiving light from the light source passing through the top opening and for reflecting such light to the edges of said aisle onto regions of the stacked material that are poorly illuminated by light passing through the bottom opening.

In one form of the invention, the auxiliary reflectors define reflective surfaces extending lengthwise of the aisle from the vicinity of a first vertical reference plane containing said axis and extending across the aisle. In so extending, the reflective surfaces are angled upwardly so as to direct the beams reflected from each reflective surface along the aisle length via a higher path than would be followed by the beam absent this upward angling. Additionally, the reflective surfaces extend from a second vertical reference plane normal to the first one and containing said axis; and in so extending, the reflective surfaces are angled upwardly so as to direct the beam reflected from each reflective surface transversely of said aisle via a higher path than would be followed by such beam absent this latter upward angling.

BRIEF DESCRIPTION OF FIGURES

For a better understanding of the invention, reference may be had to the following detailed description taken in conjunction with the accompanying drawings, wherein.

DETAILED DESCRIPTION OF EMBODIMENT

Figure 1:
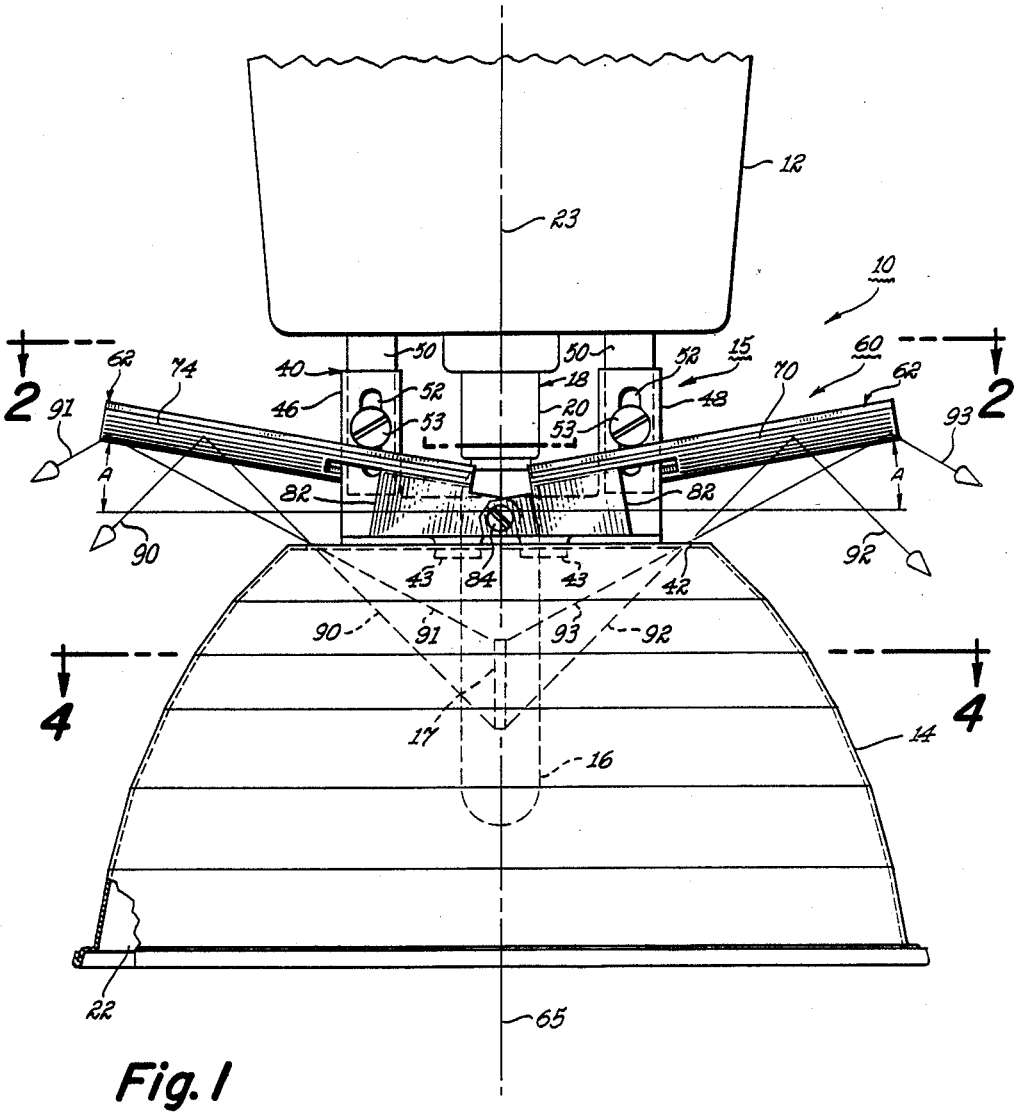
FIG. 1 is a side elevational view of a luminaire embodying one form of the invention.

Referring now to FIG. 1, there is shown a luminaire 10 of a type that is adapted to be mounted over a warehouse aisle or the like for illuminating material stacked along the edges of the aisle. The luminaire comprises a conventional ballast housing schematically illustrated at 12 suitably suspended from ceiling structure (not shown) and containing the usual ballast components. From the bottom of the ballast housing, there is suspended a generally dome-shaped main reflector 14, typically of aluminum sheet. Adjustable support structure 15 (soon to be described in more detail) is relied upon for suspending the reflector from the ballast housing.

Mounted within the main reflector 14 is a lamp 16, which is typically a high intensity gaseous discharge lamp such as a sodium vapor, mercury vapor, or metal halide lamp. The arc tube of the lamp is schematically shown at 17. This lamp 16 is supported within a socket 18 that comprises a tubular housing 20 of electrical insulating material mounted on the bottom wall of the ballast housing 12. The lamp 16 is suitably electrically connected through the socket to the ballast components in housing 12 for operation thereby.

Figure 4:
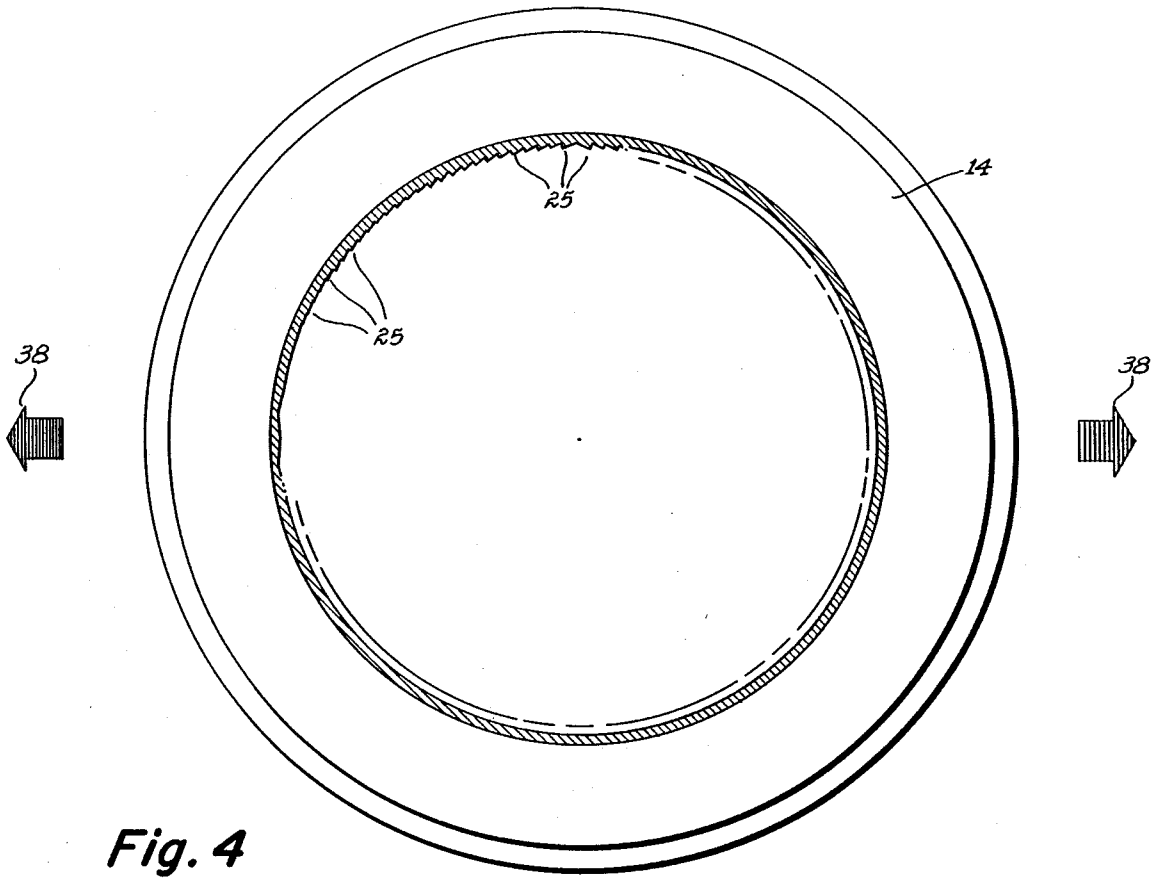
FIG. 4 is a sectional view along the line 4—4 of FIG. 1.

The luminaire is normally mounted above the floor of the warehouse aisle midway between the edges of the aisle, with the bottom opening 22 of the main reflector 14 facing downwardly and lamp 16 extending along the central vertical axis 23 of the main reflector. Light from the lamp 16 is reflected off the internal surface of the dome-shaped main reflector 14, passing downwardly and outwardly through the bottom opening 22. The reflector 14 is provided on its internal surface with facets, some of which are shown at 25 in FIG. 4, which are located and shaped to receive light from the lamp and to reflect such light through bottom opening 22 along the length of the aisle and onto the stacks at the edges of the aisle. The details of the facets 25 and their method of construction are not a part of the present invention but are disclosed and claimed in our application Ser. No. 281,171, filed Dec. 7, 1988. A typical distribution of such light is illustrated in FIGS. 4 and 5 of the aforesaid Hogue et al U.S. Pat. No. 4,303,971, where it can be seen that a major portion of the reflected light illuminates the lower portions of the stacks at locations spaced along the aisle from the luminaire. Where a plurality of such luminaires are provided at spaced locations along the length of the aisle, the luminaires are usually relied upon to direct most of the reflected light onto areas approximately midway between the luminaires. Direct light from the lamp illuminates the areas of the aisle and the stacks that are located beneath the luminaire in proximity thereto. Referring to the illustrated luminaire, the aisle length runs in the direction of arrows 38 of FIG. 2.

Figure 3:
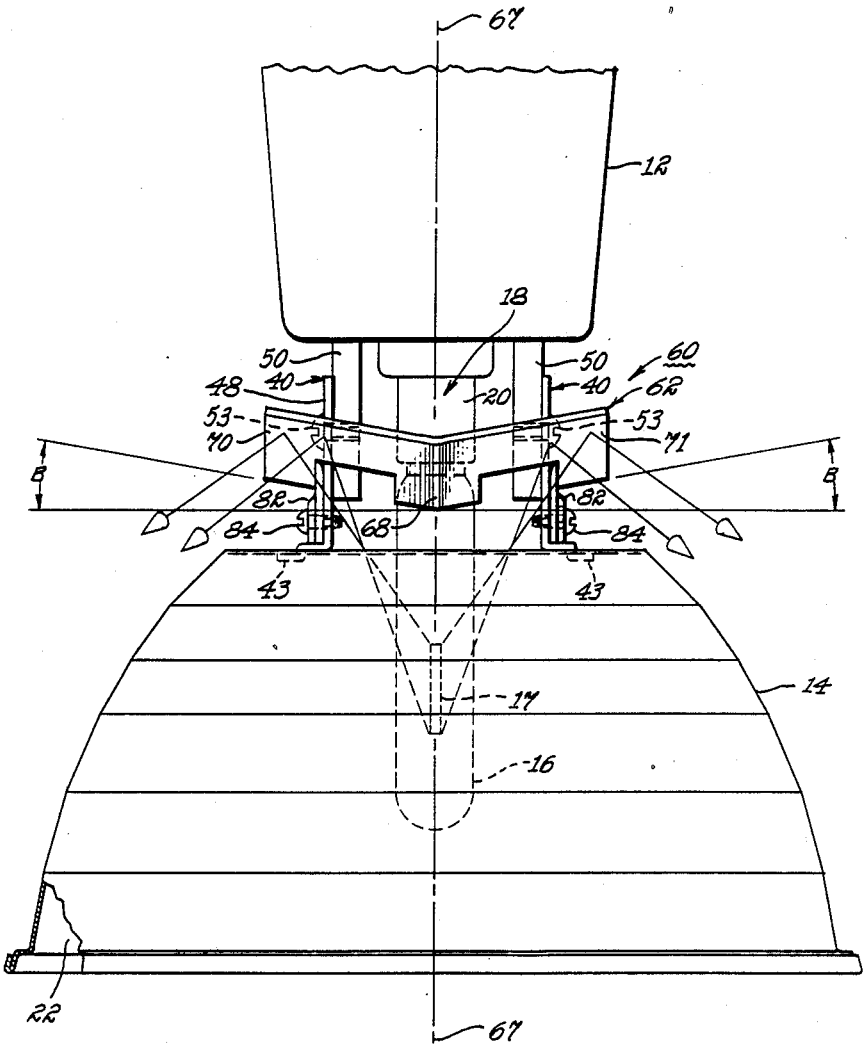
FIG. 3 is a front view of the luminaire of FIG. 1 as viewed from one side of FIG. 1.

The support means 15 for the main reflector 14 is adjustable to control the photometric distribution of the light along the aisle. By lowering the main reflector 14 with respect to the lamp 16, the extent of the photometric distribution along the aisle is decreased, and by raising the main reflector with respect to the lamp, this extent is increased. To enable such adjustments to be made, the main reflector is provided with two vertically-extending brackets 40 that are respectively positioned adjacent opposite edges of an elongated opening 42 in the top of the main reflector 14. These brackets 40 are fixed to the main reflector 14 by suitable means, such as feet 43 on the brackets extending into mating slots in the top of the main reflector, as shown in FIG. 3. Each of these brackets 40, as viewed in FIG. 1, is of U-shaped form and comprises vertically-extending legs 46 and 48 that are positioned adjacent vertically-extending posts 50 that project downwardly from and are fixed to the bottom of the ballast housing 12. The legs 46 and 48 of the brackets contain slots 52 through which extend screws 53 that are received in mating threaded holes in the posts 50. When the screws 53 are loosened, the slotted brackets 40 can be slid up or down along posts 50, raising or lowering the reflector 14. When the desired position is obtained, the screws 53 are tightened to lock the brackets and the reflector in this position.

Figure 2:
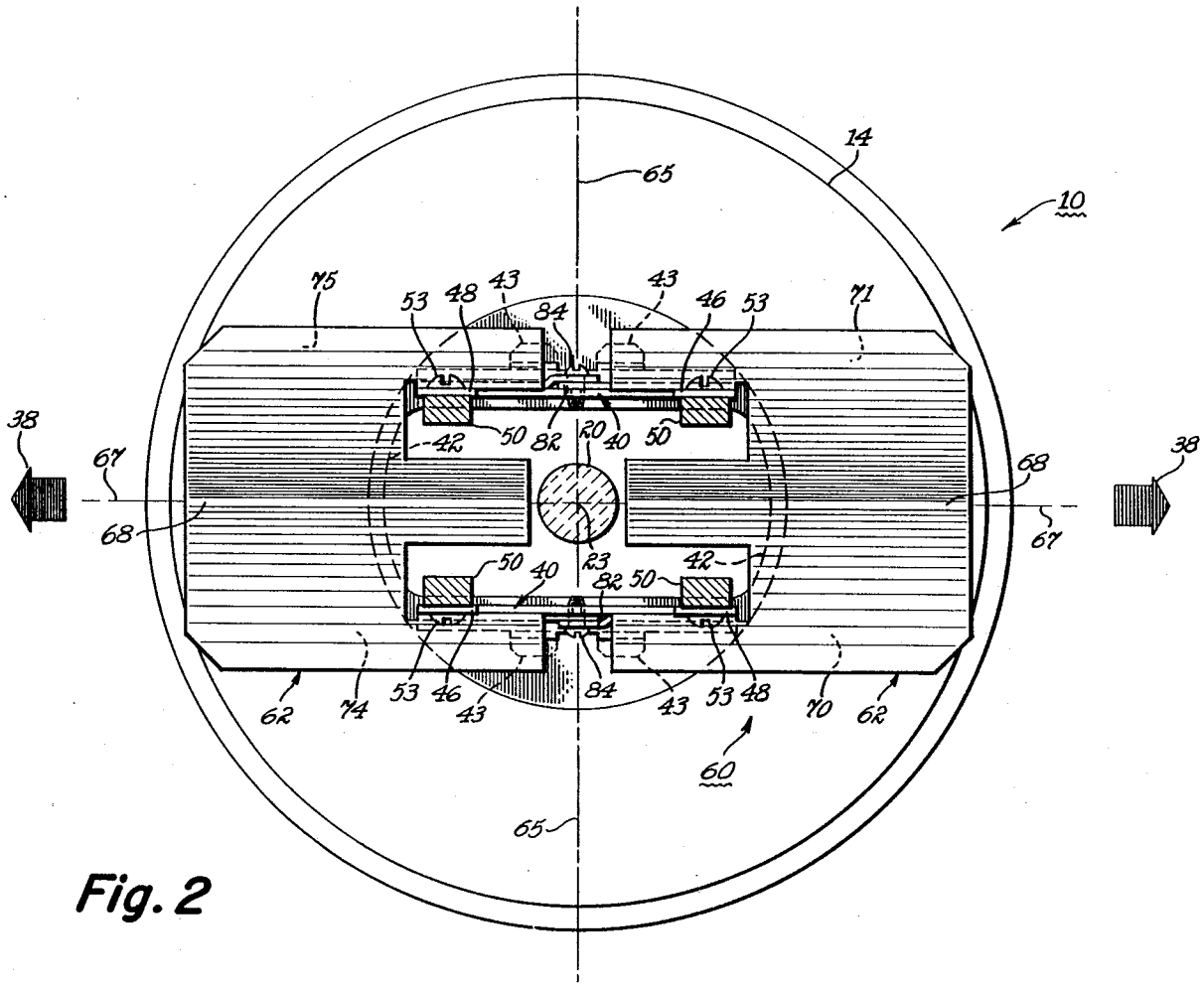
FIG. 2 is a sectional view along the line 2—2 of FIG. 1.

As pointed out hereinabove, a problem that is present with conventional aisle-lighting luminaires that provide the above-described pattern of light distribution is that the upper areas of the stacks at the edges of the aisle are left relatively dark and difficult to see. For overcoming this problem, we have provided our luminaire with auxiliary reflector means 60 located above the opening 42 in the top of the main reflector 14. This opening 42 is best seen in FIG. 2, where it is shown in dotted-line form as an elongated opening, having its longer dimension extending along the length of the aisle. The auxiliary reflector means 60 comprises two plate members 62, each extending along the length of the aisle from a central vertical plane 65 (FIG. 2) that includes the central vertical axis of the main reflector 14.

Each of the plate members 62 is creased where it intersects a second vertical reference plane 67 that is normal to the first reference plane 65 and extends through the central axis of the reflector, running along the aisle length. The crease 68 divides each plate member into two reflective segments, thus providing a total of four such reflective segments 70, 71, 74, 75 above the top opening 42 for dividing the light emerging through top opening 42 into four beams. The reflective segments are oriented to direct this light to the sides of the aisle high on the stacks located therealong, i.e., into areas poorly illuminated by light passing through the bottom opening 22 of the main reflector. To provide this orientation, each of the reflective plate members 62 (and, hence, each of the reflective segments) in extending from reference plane 65 outwardly, is angled upward at an angle A from the horizontal, as seen in FIG. 1. In addition, each of the reflective segments 70, 71, 74, 75, in extending away from the crease 68 (or away from the second reference plane 67) is angled upward at an angle B, as seen in FIG. 3. Typical values for angles A and B are 10 degrees for each.

Another way of describing the orientation of the reflective segments 70, 71, 74, 75 is that two of them (70,71) extend in paired relationship from the reference plane 65 in one direction along the aisle length, and the other two (74,75) extend in paired relationship in an opposite direction along the aisle length. The reflective surfaces of each pair are disposed in a V-configuration (as seen in FIG. 3) when viewed from a plane parallel to the reference plane 65. In addition, the surfaces of each pair in extending from reference plane 65 are angled upwardly as viewed in FIG. 1.

Because the light used by the auxiliary reflector means 60 is light exiting through the top of the main reflector, it is easier to direct toward the normally difficult-to-light areas of the stacks than would be the case with light emerging through the bottom opening 22. A major factor contributing to this ease is the higher elevation of the auxiliary reflectors. In addition, because the area of the main reflector dedicated to the top opening 42 would otherwise be directing light to an area directly below the main reflector, where usually there is already more than sufficient light, the presence of the top opening does not objectionably interfere with illumination in this nadir region. Moreover, the remaining portions of the reflector, dedicated to controlling the main beams, remain intact and are still able to perform their intended functions.

With reflective segments oriented as illustrated, i.e., angled upwardly at about 10 degrees above horizonal in both side-to-side and end-to-end directions, light is directed outwardly along the aisle at 60 to 90 degrees above nadir and outwardly from the center of the aisle at 25 to 75 degrees above nadir. FIG. 1 shows light rays 90, 91, 92 and 93 emitted from the ends of the lamp arc tube 17, passing through the top opening 42 at an extremity of the opening, and reflected off of one of the reflective segments in a direction along the aisle length. Similar rays are shown in FIG. 3 being reflected off the reflective segments in a direction transversely of the aisle.

While the specific orientation of the reflective segments 70, 71, 74 and 75 referred to above is desirable for many installations, it is to be understood that our invention in its broader aspects comprehends other orientations, which might be well suited for other installations and applications. It is also to be understood that my invention in its broader aspects comprehends curved reflective surfaces instead of the planar surfaces shown. Such curving of these surfaces can be used to concentrate or to spread the beams reflected from these surfaces.

For supporting the reflecting plates 62 in the illustrated positions, each plate is provided with two spaced-apart vertically-extending legs 82 at its proximate end. These legs 82 straddle the brackets 40 and are fastened to the brackets by sheet metal screws 84 extending through the legs and threaded into the brackets. The bottom edge of these legs is shaped to form an abutment that bears against the structure beneath it to help hold the reflecting plates in their desired position.

It will be apparent that in the illustrated embodiment, the auxiliary reflectors 62 are fixed with respect to the main reflector 14. This is a simple and economical way of mounting the auxiliary reflectors and serves also to enable the height of the light output from auxiliary reflectors to be changed directly in accordance with changes in the height of the light output from the main reflector, as determined by adjustments in the reflector support means 15. It is to be understood, however, that the invention in its broader aspects comprehends other ways of mounting the auxiliary reflectors 62, including mounting them directly on the ballast housing 12, (i.e., independently of adjustable mounting 15) so that their position with respect to lamp 16 is unaffected by adjustments in the height of the main reflector with respect to the lamp 16.

While the illustrated preferred embodiment of the invention comprises a lamp extending along the axis 23 of the main reflector, it is to be understood that our invention in its broader aspects comprehends use in the luminaire of a main reflector of the type in which the lamp extends otherwise with respect to such axis, e.g., transversely, as illustrated for example in U.S. Pat. No. 4,358,816 - Soileau, assigned to the assignee of the present invention. In this modified embodiment, auxiliary reflecting means of the same character as disclosed herein is present over a top opening in the main reflector.

While we have shown and described particular embodiments of our invention, it will be obvious to those skilled in the art that various changes and modifications may be made without departing from our invention in its broader aspects; and we, therefore, intend herein to cover all such changes and modifications as fall within the true spirit and scope of our invention.

What we claim as new and desire to secure by Letters Patent of the United States is:

1. A luminaire comprising:

A generally dome-shaped main reflector having a wall extending about an axis and defining a bottom opening and a top opening in said main reflector that are located on said axis, a lamp within said main reflector extending substantially along said axis and defining a light source located in a position between said top and bottom openings, said main reflector being adapted by support and adjustable means to be positioned relative to said light source, said main reflector being further adapted by said support and adjustable means to be mounted with said axis extending substantially vertically in a location above a warehouse aisle for illuminating stacked material along both edges of the aisle with light passing through said bottom opening, and auxiliary reflectors positioned above said top opening by said support and adjustable means for receiving light from said source passing through said top opening and for reflecting said latter light to the edges of said aisle onto regions of said stacked material that are poorly illuminated by light passing through said bottom opening said support and adjustable means serving as means for adjusting the position of said main reflector with respect to said light source while at the same time maintaining the positioning of said auxiliary reflector above said opening, said adjustment of said position of said reflector relative to said light source controlling the photometric distribution along said aisle while at the same time directly affecting the illumination onto regions of said stacked material that are poorly illuminated.

2. The luminaire of claim 1 in which structure positioned above said top opening forms said auxiliary reflectors, said auxiliary reflectors having reflective surfaces facing said top opening for receiving light from said source passing through said top opening and for reflecting said latter light outwardly and downwardly with respect to said main reflector.

3. The luminaire of claim 2 in which said reflective surfaces are adapted to extend lengthwise of said aisle from the vicinity of a first vertical reference plane containing said axis adapted to extend across said aisle.

4. The luminaire of claim 3 in which said reflective surfaces in extending away from said first vertical reference plane are angled upwardly with respect to horizontal plane so as to direct the beam reflected from each reflective surface along the length of said aisle via a higher path than would be followed by said beam absent said upward angling.

5. The luminaire of claim 4 in which said reflective surfaces also extend from a second vertical reference plane that is normal to said first vertical reference plane and contains said axis, said reflective surfaces in extending from said second vertical reference plane are angled upwardly with respect to horizontal plane so as to direct the beam reflected from each reflective surface transversely of said aisle via a higher path than would be followed by such beam absent said latter upward angling.

6. The luminaire of claim 3 in which said reflectors define four reflective segments, two of which extend from said first reference plane in paired relationship in one direction along said aisle length and two of which extend from said first reference plane in paired relationship in an opposite direction along said aisle length, the reflective surfaces of each pair being disposed in V-configuration with respect to each other as viewed in planes parallel to said first reference plane.

7. The luminaire of claim 6 in which the reflective surfaces of each of the two pairs in extending from said first reference plane are angled upwardly in a direction as viewed in a second vertical reference plane normal to said first plane.

8. The luminaire of claim 3 in which each of said auxiliary reflectors comprises a sheet-metal member creased along a line adapted to extend along the length of said aisle, the portions of said member on opposite sides of said crease constituting two of said reflective surfaces.

9. The luminaire of claim 8 in which said creases extend away from said first vertical reference plane via paths that are angled upwardly with respect to horizontal plane.

10. The luminaire of claim 8 in which said reflective surfaces on opposite sides of said crease extend away from said crease via paths that are angled upwardly with respect to horizontal plane.

11. The luminaire of claim 8 in which:

(a) said creases extend away from said first vertical reference plane via paths that are angled upwardly with respect to horizontal, and (b) said reflective surfaces on opposite sides of said crease extend away from said crease via paths that are angled upwardly with respect to horizontal plane.

12. The luminaire of claim 1 in which:

(a) said light passing through said bottom opening effectively illuminates lower portions of said stacked material, and (b) said light passing through said top opening and reflected by said auxiliary reflectors effectively illuminates upper portions of said stacked material.

13. In a luminaire comprising a generally dome-shaped main reflector having a bottom opening and a top opening and adapted to receive a lamp defining a light source located in a position between said top and bottom openings, said main reflector being adapted by support and adjustable means to be positioned relative to said light source, said main reflector being further adapted by said support and adjustable means for mounting in a location above a warehouse aisle for illuminating stacked material along both edges of the aisle with light passing through said bottom opening, the combination with said main reflector of: auxiliary reflector means positioned above said top opening by said support and adjustable means for receiving light from said source passing through said top opening and for reflecting said latter light to the edges of said aisle onto regions of said stacked material that are poorly illuminated by light passing through said bottom opening said support and adjustable means serving as means for adjusting the position of said main reflector with respect to said light source while at the same time maintaining the positioning of said auxiliary reflector above said opening, said adjustment of said position of said reflector relative to said light source controlling the photometric distribution along said aisle while at the same time directly affecting the illumination onto regions of said stacked material that are poorly illuminated.

14. The combination of claim 13 in which said auxiliary reflector means comprises auxiliary reflectors having reflective surfaces facing said top opening for receiving light from said source passing through said top opening and for reflecting said latter light outwardly and downwardly with respect to said main reflector.

15. The luminaire of claim 14 in which said reflective surfaces are adapted to extend lengthwise of said aisle from the vicinity of a first reference plane located centrally of said main reflector and adapted to extend across said aisle.

16. The luminaire of claim 15 in which said reflective surfaces in extending away from said first vertical reference plane are angled upwardly with respect to horizontal plane so as to direct the beam reflected from each reflective surface along the length of said aisle via a higher path than would be followed by said beam absent said upward angling.

17. The luminaire of claim 16 in which:

(a) said main reflector has a central axis, (b) said reflective surfaces also extend from a second vertical reference plane that is normal to said first vertical reference plane and contains said central axis, and (c) said reflective surfaces in extending from said second vertical reference plane are angled upwardly with respect to horizontal plane so as to direct the beam reflected from each reflective surface transversely of said aisle via a higher path than would be followed by such beam absent said latter upward angling.

18. The luminaire of claim 15 in which said reflectors define four reflective segments, two of which extend from said first reference plane in paired relationship in one direction along said aisle length and two of which extend from said first reference plane in paired relationship in an opposite direction along said aisle length, the reflective surfaces of each pair being disposed in V-configuration with respect to each other as viewed in planes parallel to said first reference plane.

19. The luminaire of claim 18 in which the reflective surfaces of each of the two pairs in extending from said first reference plane are angled upwardly in a direction as viewed in a second vertical reference plane normal to said first plane.

20. The luminaire of claim 15 in which each of said auxiliary reflectors comprises a sheet-metal member creased along a line adapted to extend along the length of said aisle, the portions of said member on opposite sides of said crease constituting two of said reflective surfaces.

21. The luminaire of claim 20 in which said creases extend away from said first vertical reference plane via paths that are angled upwardly with respect to horizontal plane.

22. The luminaire of claim 20 in which said reflective surfaces on opposite sides of said crease extend away from said crease via paths that are angled upwardly with respect to horizontal plane.

23. The luminaire of claim 20 in which:

(a) said creases extend away from said first vertical reference plane via paths that are angled upwardly with respect to horizontal, and (b) said reflective surfaces on opposite sides of said crease extend away from said crease via paths that are angled upwardly with respect to horizontal plane.

24. The luminaire of claim 12 in which:

(a) said light passing through said bottom opening effectively illuminates lower portions of said stacked material, and (b) said light passing through said top opening and reflected by said auxiliary reflectors effectively illuminates upper portions of said stacked material.

* * * * *